US012378779B2

(12) United States Patent
Sánchez Gómez

(10) Patent No.: US 12,378,779 B2
(45) Date of Patent: Aug. 5, 2025

(54) PROTECTIVE DEVICE FOR CERAMIC PIECES

(71) Applicant: GERMANS BOADA, S.A., Rubi (ES)

(72) Inventor: Santiago Sánchez Gómez, Rubi (ES)

(73) Assignee: GERMANS BOADA, S.A., Rubi (ES)

( * ) Notice: Subject to any disclaimer, the term of this patent is extended or adjusted under 35 U.S.C. 154(b) by 0 days.

(21) Appl. No.: 18/263,482

(22) PCT Filed: Nov. 4, 2021

(86) PCT No.: PCT/ES2021/070793
§ 371 (c)(1),
(2) Date: Jul. 28, 2023

(87) PCT Pub. No.: WO2023/079191
PCT Pub. Date: May 11, 2023

(65) Prior Publication Data
US 2024/0102294 A1 Mar. 28, 2024

(51) Int. Cl.
*E04F 21/00* (2006.01)
*E04F 15/08* (2006.01)
*E04F 21/18* (2006.01)

(52) U.S. Cl.
CPC ..... *E04F 21/0092* (2013.01); *E04F 15/08* (2013.01); *E04F 21/1877* (2013.01)

(58) Field of Classification Search
CPC ... E04F 21/0092; E04F 21/22; E04F 21/1844; E04F 21/1877; E04F 13/0892; E04F 15/02005
See application file for complete search history.

(56) References Cited

U.S. PATENT DOCUMENTS 7,257,926 B1 * 8/2007 Kirby ..... E04F 21/22 52/749.11
2019/0093372 A1 3/2019 Russo

FOREIGN PATENT DOCUMENTS

| | | |
|---|---|---|
| EP | 3263799 | 1/2018 |
| ES | 1243058 | 3/2020 |
| ES | 2773772 | 7/2020 |
| WO | 2014022889 | 2/2014 |
| WO | 2020245711 | 12/2020 |

OTHER PUBLICATIONS

WIPO, International Search Report for PCT/ES2021/070793, Jun. 29, 2022.

* cited by examiner

*Primary Examiner* — Babajide A Demuren
(74) *Attorney, Agent, or Firm* — Hodgson Russ LLP

(57) ABSTRACT

The present invention relates to a protective device for ceramic pieces, said device suitable for resting on the upper surface of at least two ceramic pieces (40, 41) and which forms a bearing surface for a tightening element (204, 305) of a spacer-leveller device (20, 30) for ceramic pieces. The protective device comprises: a lower bearing surface (101) on the ceramic pieces (40, 41) to be installed; an upper surface (102) comprising a first circular track (106) for possible bearing of a first threaded tightening element (204) of a first spacer-leveller device (20); a second diametrical track (109), forming a possible bearing surface, with the possibility of longitudinal displacement, for a second tightening element (305), by way of a wedge, of a second spacer-leveller device (30); and a lateral surface (103) with projections (104) for manually holding the protective device (10).

5 Claims, 3 Drawing Sheets

PROTECTIVE DEVICE FOR CERAMIC PIECES

CROSS-REFERENCE TO RELATED APPLICATION

This application is a U.S. national stage entry of International Application No. PCT/ES2021/070793, filed Nov. 4, 2021, the entire disclosure of which is incorporated herein by reference.

FIELD

The present invention is applicable to the sector dedicated to the manufacture of construction elements and more specifically related to the installation of ceramic pieces.

BACKGROUND

Currently in the installation of ceramic pieces, such as tiles or similar, it is common to use spacer-leveller devices for the successive ceramic pieces such that they are aligned and coplanar, maintaining the separation between them constant.

These spacer-leveller devices generally comprise: a base that is located below the ceramic pieces and that extends at the top into a separator of a certain thickness and said separator into an upper structure on which a tightening element acts.

In the mounting position, said separator lies between the facing edges of the adjacent ceramic pieces; the thickness of said separator determining the separation between the ceramic pieces; while the structure protrudes above the ceramic pieces to interact with the tightening element that presses the upper surface of the ceramic pieces towards the base, leveling their upper surface.

In a known type of spacer-leveller device, the upper structure is made up of a threaded rod and the tightening element by a threaded bell that, when mounted on said rod, presses with its lower end on the ceramic pieces, leveling them.

A problem with these devices is that when the tightening element is rotated, it can scratch the upper surface of the ceramic pieces.

The solution to this problem consists of arranging, between the upper surface of the ceramic pieces and the tightening element, a protective device, in the form of a disk, provided with a groove for receiving the rod and the separator of the spacer-leveller device. However, it can happen that the protective device rotates together with the tightening element when the latter exerts a high pressure against the upper surface of the protective device, with the risk that the protective device itself damages the ceramic pieces.

In another known type of spacer-leveller device, the structure protruding above the ceramic pieces is made up of a plate provided with a window into which a wedge-shaped tightening element is progressively introduced in the front direction, exerting a pressure against the upper surface of the ceramic pieces, causing their leveling.

In this case, the tightening element does not rotate as in the previous case, but rather is displaced longitudinally over the surface of the tiles, which can also cause scratching or deterioration of the same. To prevent this scratching, the solution currently used is to position a strip of material over the area of action of the tightening element that acts as a protective device and that bears no relation to the protector used in the previously mentioned, thread-actuated, spacer-leveller devices.

An additional drawback is that the tightening elements, which are reusable, deteriorate due to their friction against the surface of the ceramic piece or the protector of said ceramic piece, during their displacement under a progressive tightening force, which reduces the useful life of said tightening elements and the number of reuses thereof.

The technical problem posed is a protective device for ceramic pieces that can be used interchangeably with thread-actuated or wedge-actuated spacer-leveller devices that facilitates its manual holding, preventing its undesired rotation when used in thread-actuated spacer-leveller devices and that allows the useful life of the tightening element and the number of reuses thereof to be extended

SUMMARY

The protective device for ceramic pieces that is the object of this invention has characteristics suitable for solving the technical problem posed and that allow it to be used interchangeably with a spacer-leveller device provided with a threaded tightening element or with a spacer-leveller device provided with a tightening element, by way of a wedge.

Said protective device comprises a lower bearing surface on the ceramic pieces to be installed, an upper surface, and a lateral surface provided with at least one pair of diametrically opposed projections, provided with suitable surfaces for manually holding the device, without the possibility of rotation, when tightening the protective device against ceramic pieces with a threaded tightening element.

The upper surface of the protective device comprises at least two first appendages protruding towards the upper area, in a circular arrangement, which externally delimit a first circular track for possible bearing, with the possibility of rotation, of a first threaded tightening element of a first spacer-leveller device; and at least two diametrically opposed lateral openings.

Said upper surface also comprises at least two second appendages protruding towards the upper area, arranged parallel and delimiting a second diametrical track, aligned with the lateral openings, and suitable for possible bearing, with the possibility of longitudinal displacement, of a second tightening element, by way of a wedge, of a second spacer-leveller device.

Preferably, the body of the protective device comprises a circular, disk-like contour, from which the aforementioned diametrically opposed projections protrude laterally.

According to the invention, the protective device comprises in its central area a first groove parallel to the second track, for possible mounting on the first spacer-leveller device that is actuated by a threaded tightening element, and a second groove, perpendicular to said first groove, for possible mounting on the second spacer-leveller device that is actuated by a tightening element in the manner of a wedge.

BRIEF DESCRIPTION OF THE DRAWINGS

As a complement to the description provided herein, and for the purpose of helping to make the features of the invention more readily understandable, the present specification is accompanied by a set of drawings which, by way of illustration and not limitation, represent the following.

DETAILED DESCRIPTION

Figure 1:
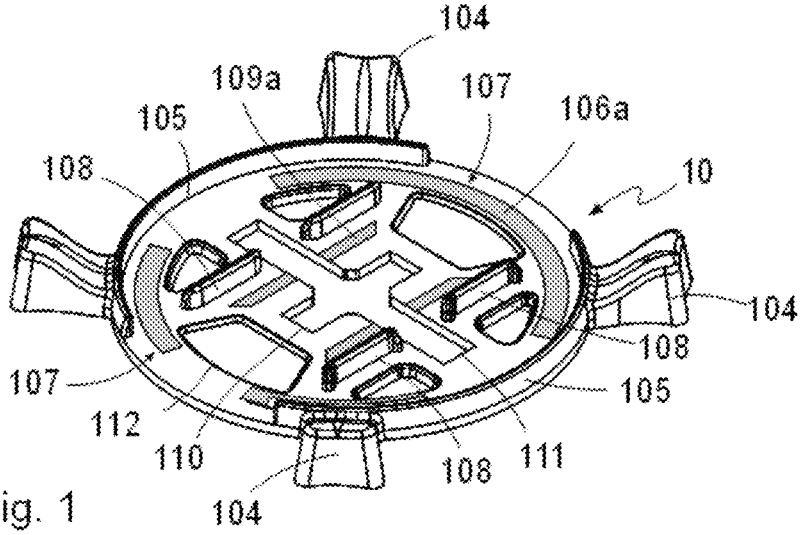
FIG. 1 shows a perspective view of an exemplary embodiment of the protective device for ceramic pieces, according to the invention.

In the exemplary embodiment shown in the attached figures, the protective device (10) for ceramic pieces comprises a flat lower surface (101), an upper surface (102) provided with first appendages (105) and second appendages (108) protruding towards the upper area, and a substantially circular lateral surface (103), provided in this case with two pairs of diametrically opposed and perpendicular projections (104) two by two, which allows the effort required to tighten to be considerably reduced.

The first appendages (105) externally delimit a first circular track (106) and two diametrically opposed lateral openings (107).

The second appendages (108) laterally delimit a second track (109) oriented in the diametral direction and aligned with the lateral openings (107) delimited by the first appendages (105).

This protective device (10) comprises in its central area a first groove (110) parallel to the second track (109) for mounting on a first spacer-leveller device (20) and a second groove (111) perpendicular to the previous one and suitable for mounting on a second spacer-leveller device (30), as will be explained below.

The protective device (10) also has through holes (112) to reduce the weight of the protective device (10) and the material necessary for its manufacture, especially taking into account that the first appendages (105) and the second appendages (108) additionally act as reinforcing elements of the protective device.

Figure 4:
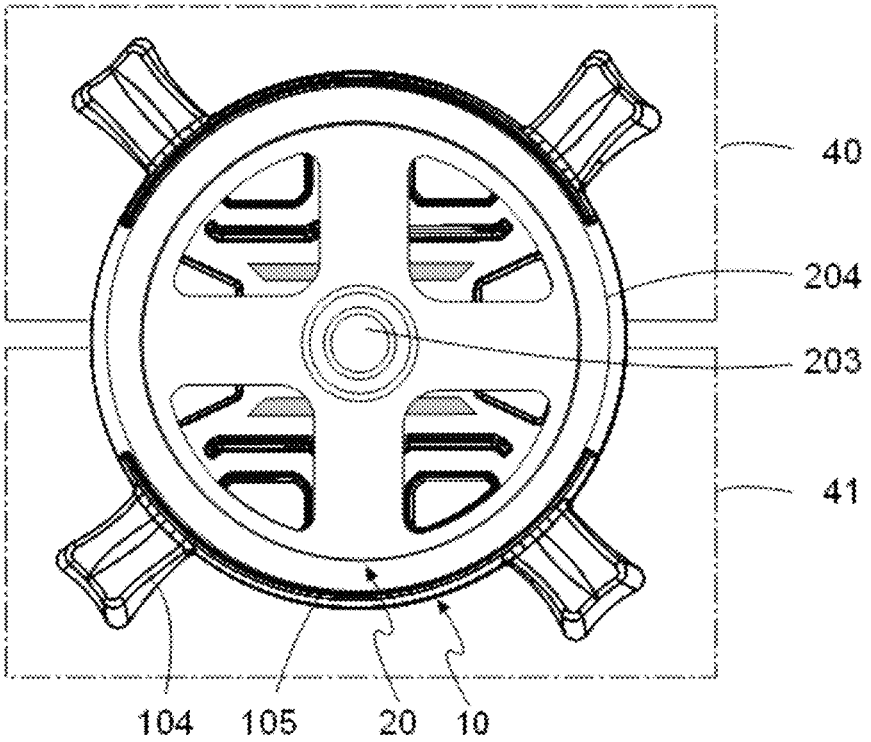
FIGS. 4 and 5 show paths seen in top plan and elevation views of the protective device for ceramic pieces of the previous figures in a position of use, together with a first spacer-leveller device provided with a first threaded tightening element.
Figure 5:
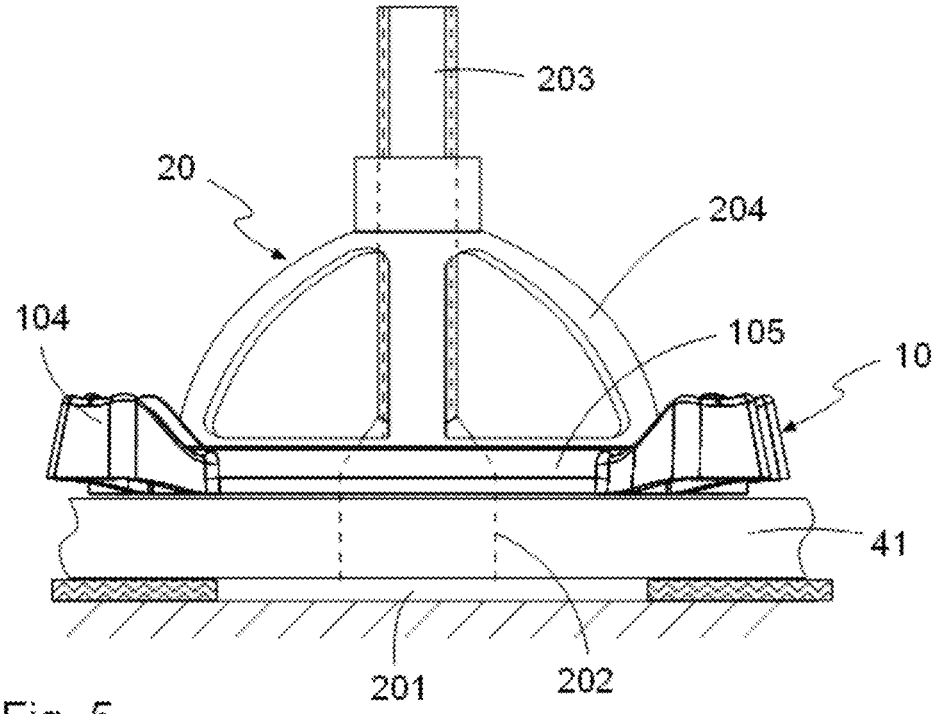

FIGS. 4 and 5 show the protective device (10) in a position of use, during the installation of two ceramic pieces (40, 41) and their spacing and leveling by means of a first spacer-leveller device (20) provided with: a base (201) located below the ceramic pieces (40, 41), a separator (202) that is located between the opposite ends of said ceramic pieces, determining the separation between them, and a structure (203), represented in this case by a threaded rod, on which a first tightening element (204) is mounted, made up of a threaded bell that exerts pressure on the first track (106) of the protective device (10) arranged between the upper surfaces of the ceramic pieces (40, 41) and said first tightening element (204).

The protective device (10) prevents the first tightening element (204) from coming into direct contact with the upper surfaces of the ceramic pieces (40, 41), which could cause them to be scratched or damaged. In addition, in this case, the pairs of projections (104), facing each other diametrically, allow the manual holding of the protective device (10) to be carried out comfortably, preventing it from rotating dragged by the first tightening element (204) and preventing the protective device itself (10) from damaging the surface of the ceramic pieces (40, 41).

Figure 6:
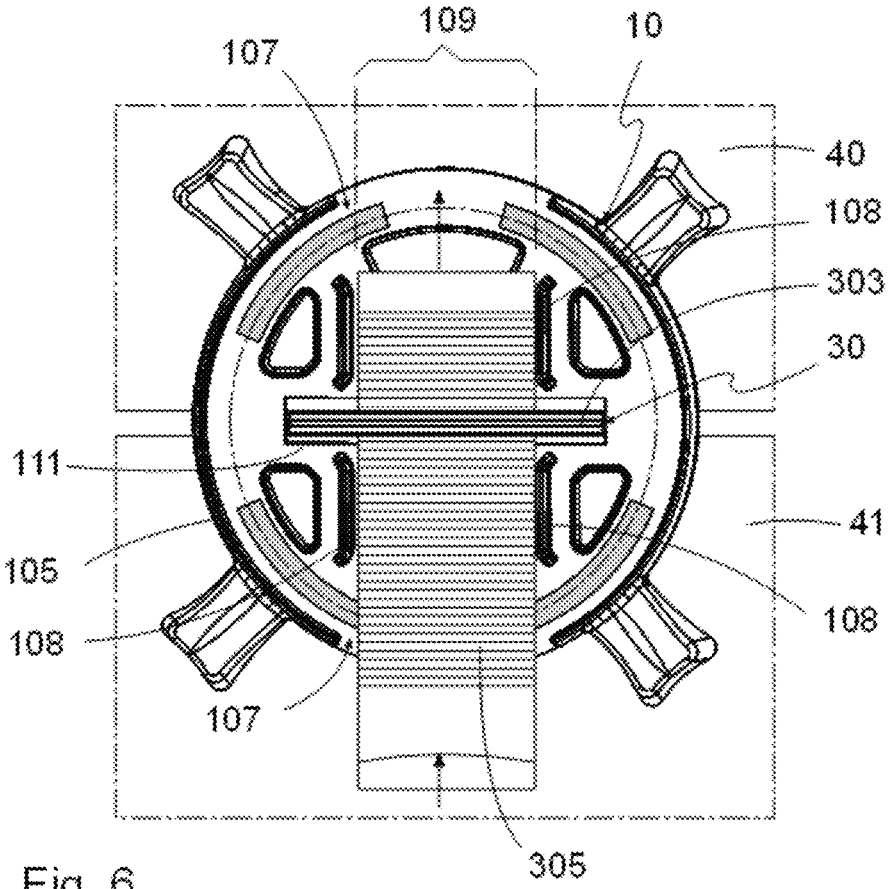
FIGS. 6 and 7 show paths seen in top plan and profile views of the protective device of the previous figures in a position of use together with a second spacer-leveller device provided with a second tightening element in the manner of a wedge.
Figure 7:
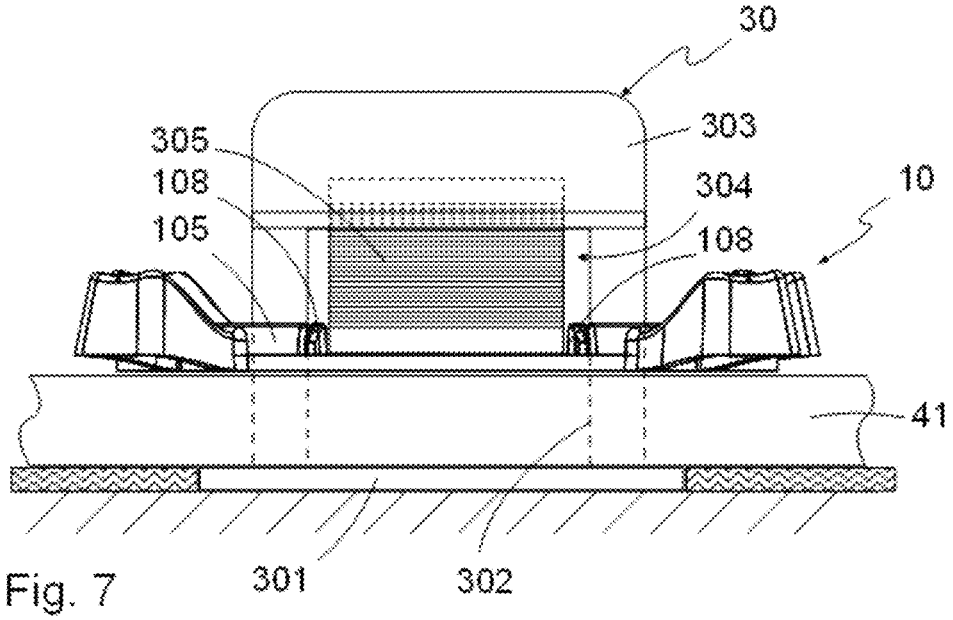

As can be seen in FIGS. 6 and 7, the characteristics of the protective device (10) also allow its use with a second spacer-leveller device (30) that can be actuated by means of a second tightening element (305) formed by a wedge that is displaced longitudinally on the second diametric track (109) of the protective device (10); said protective device (10) preventing direct contact of the second tightening element (305) against the upper surface of the ceramic pieces (40, 41).

In this case, the second spacer-leveller device (30) comprises, as in the previous case: a base (301) located below the ceramic pieces (40, 41), a separator (302) arranged between the ends facing each other of said ceramic pieces (40, 41) and a structure (303) that protrudes above the ceramic pieces and which, in this case, is made up of a plate provided with a window (304) into which the second wedge-shaped tightening element (305) is progressively introduced when being displaced longitudinally on the second diametrical track (109) of the protective device (10), said second tightening element (305) pressing the protective device (10) against the upper surface of the ceramic pieces (40, 41), to achieve their leveling.

Figure 2:
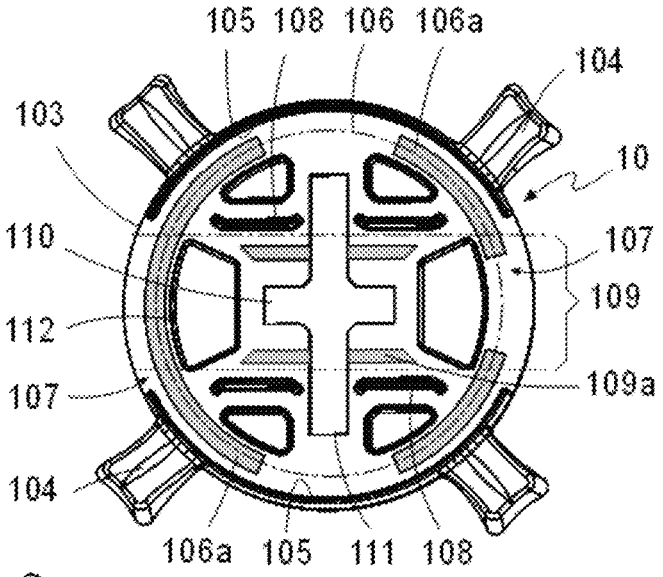
FIGS. 2 and 3 show the paths of the protective device for ceramic pieces of FIG. 1 seen, respectively, in top plan and in profile.
Figure 3:
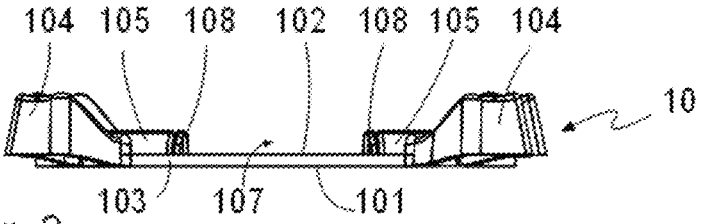

As can be seen more clearly in FIGS. 1 and 2, the first track (106) and the second track (109) comprise polished areas (106*a*, 109*a*), with a low coefficient of friction.

These polished areas (106*a*, 109*a*) form bearing and sliding surfaces of the tightening element (204, 305) of the first and second spacer-leveller device (20, 30) respectively, and allow the wear due to friction of said tightening elements to be reduced during their displacement on the protective device (10), extending the useful life of said tightening elements (204, 305) and the number of possible reuses thereof.

Having sufficiently described the nature of the invention, in addition to a preferred exemplary embodiment, it is hereby stated for the relevant purposes that the materials, shape, size and layout of the described elements may be modified, provided that it does not imply altering the essential features of the invention claimed below.

The invention claimed is:

1. A protective device for ceramic pieces, suitable for resting on an upper surface of at least two ceramic pieces and forming a bearing surface of a tightening element of a spacer-leveller device for ceramic pieces, comprising:

- a base, a separator of the ceramic pieces and a structure on which said tightening element acts;
- a lower bearing surface on the ceramic pieces to be installed,
- an upper surface comprising:
  - at least two first appendages protruding upwardly, in a circular arrangement, which externally delimit a first circular track, configured to allow for rotation, of a first threaded tightening element of a first spacer-leveller device; and at least two diametrically opposed side openings;
  - at least two second appendages protruding towards the upper area, arranged parallel and delimiting a second diametrical track, aligned with lateral openings and forming a bearing surface, providing longitudinal displacement, of a second tightening element, by way of a wedge, of a second spacer-leveller device and;
- a lateral surface provided with at least one pair of projections, diametrically opposed, for manually holding the protective device during threaded tightening of the first spacer-leveller device.

2. The protective device according to claim 1, wherein the protective device is disk-shaped, defining a circular contour.

3. The protective device according to claim 1, further comprising a centrally-located first groove parallel to the second track, configured to mount on the first spacer-leveller device, and a second groove, perpendicular to said first groove and configured to mount on the second spacer-leveller device.

4. The protective device according to claim 1, wherein a first track and the second track comprise polished areas, with a low coefficient of friction, which form bearing and sliding surfaces of the first and second tightening elements respectively.

5. The protective device according to claim 1, wherein the lateral surface comprises two pairs of projections diametrically opposed and perpendicular two by two.

* * * * *